US010281180B2

(12) United States Patent
Ma

(10) Patent No.: US 10,281,180 B2
(45) Date of Patent: May 7, 2019

(54) ECONOMIZED CYCLE WITH THERMAL ENERGY STORAGE

(71) Applicant: Carrier Corporation, Farmington, CT (US)

(72) Inventor: Zidu Ma, Ellington, CT (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/526,511

(22) PCT Filed: Nov. 10, 2015

(86) PCT No.: PCT/US2015/059847

§ 371 (c)(1),
(2) Date: May 12, 2017

(87) PCT Pub. No.: WO2016/077281

PCT Pub. Date: May 19, 2016

(65) Prior Publication Data

US 2017/0307266 A1 Oct. 26, 2017

Related U.S. Application Data

(60) Provisional application No. 62/079,704, filed on Nov. 14, 2014.

(51) Int. Cl.
*F25B 40/02* (2006.01)
*F25B 25/00* (2006.01)

(52) U.S. Cl.
CPC ..... *F25B 40/02* (2013.01); *F25B 25/005* (2013.01); *F25B 2400/053* (2013.01);
(Continued)

(58) Field of Classification Search
CPC ..... F24F 12/006; F24F 13/222; F24F 2001/0092; F24F 2013/225; Y02B 30/545;
(Continued)

(56) References Cited

U.S. PATENT DOCUMENTS 4,599,870 A * 7/1986 Hebert ..... F25B 40/00 62/238.6
4,683,726 A * 8/1987 Barron ..... F25B 39/04 62/503
(Continued)

FOREIGN PATENT DOCUMENTS

KR 20140009158 A 1/2014
WO 2007046812 A2 4/2007
(Continued)

OTHER PUBLICATIONS

Aktacir, Mehmet Azmi, "Performance Evlauation of Different Air-Side Economizer Control Methods for Energy Efficient Building", Harran University, available at: http://eng.harran.edu.tri~aktacir/A/2012_aktacir.pdf, accessed May 12, 2017, 13pgs.
(Continued)

*Primary Examiner* — Emmanuel Duke
(74) *Attorney, Agent, or Firm* — Cantor Colburn LLP

(57) ABSTRACT

In one aspect, an air conditioning system is provided. The air conditioning system includes a refrigeration circuit having a refrigerant and an economizer circuit, and a subcooling circuit thermally coupled to the refrigeration circuit, the subcooling circuit including a thermal energy storage (TES) unit and a phase change material (PCM) for thermal exchange with the refrigerant.

13 Claims, 2 Drawing Sheets

(52) U.S. Cl.
CPC ..... *F25B 2400/13* (2013.01); *F25B 2400/24* (2013.01); *F25B 2600/13* (2013.01)

(58) Field of Classification Search
CPC ..... Y02B 30/563; F25B 40/02; F25B 25/005; F25B 2600/13; F25B 2400/13; F25B 2400/24; F25B 6/04; F25B 40/00; F25B 1/00; F25B 1/005; F25B 49/02; F25B 13/00; F25B 2400/053
USPC ..... 62/605
See application file for complete search history.

(56) References Cited

U.S. PATENT DOCUMENTS

| | | | | |
|---|---|---|---|---|
| 5,755,104 | A * | 5/1998 | Rafalovich | F25B 13/00 62/205 |
| 6,857,285 | B2 * | 2/2005 | Hebert | F24F 12/006 62/280 |
| 7,150,160 | B2 * | 12/2006 | Herbert | F24F 12/006 62/274 |
| 7,757,508 | B2 * | 7/2010 | Ally | C09K 5/063 165/45 |
| 8,418,487 | B2 | 4/2013 | King | |
| 8,555,670 | B2 | 10/2013 | Furlan | |
| 8,726,663 | B2 | 5/2014 | Schroder et al. | |
| 9,212,834 | B2 * | 12/2015 | Parsonnet | F25B 1/00 |
| 2005/0028545 | A1 * | 2/2005 | Hebert | F24F 12/006 62/274 |
| 2009/0025405 | A1 * | 1/2009 | Yanik | F25B 40/00 62/117 |
| 2009/0293515 | A1 * | 12/2009 | Lifson | F24D 17/02 62/117 |
| 2012/0042656 | A1 | 2/2012 | Donnelly et al. | |
| 2012/0047891 | A1 | 3/2012 | Rosenfeld | |
| 2012/0125041 | A1 * | 5/2012 | Ishizeki | B60H 1/3216 62/509 |
| 2012/0174609 | A1 | 7/2012 | Matsuo | |
| 2013/0238294 | A1 | 9/2013 | Legbedji et al. | |
| 2014/0033708 | A1 | 2/2014 | Groppel et al. | |
| 2014/0060046 | A1 | 3/2014 | Takahashi et al. | |
| 2014/0165572 | A1 | 6/2014 | Pang et al. | |
| 2014/0182576 | A1 | 7/2014 | Harats et al. | |
| 2014/0260356 | A1 * | 9/2014 | Wu | F25D 11/025 62/79 |

FOREIGN PATENT DOCUMENTS

| | | | |
|---|---|---|---|
| WO | 2013055520 | A1 | 4/2013 |
| WO | 2013135718 | A1 | 9/2013 |
| WO | 2013165535 | A1 | 11/2013 |
| WO | 2014048482 | A1 | 4/2014 |

OTHER PUBLICATIONS

International Search Report and Written Opinion for application PCT/US2015/059847, dated Feb. 19, 2016, 11 pgs.

Parameshwaran, R., et al. "Energy Conservative Air Conditioning System Using Silver Nano-Based PCM Thermal Storage for Modern Buildings", available at: https://www.researchgate.net/publication/259129676_Energy_conservative_air_conditioning_system_using_silver_nano-based_PCM_thermal_storage_for_modern_buildings, Feb. 2014, 6pgs.

European Office Action for application EP 15797759.6, dated May 3, 2018, 5 pages.

* cited by examiner

ECONOMIZED CYCLE WITH THERMAL ENERGY STORAGE

FIELD OF THE INVENTION

The subject matter disclosed herein relates to air conditioning systems, and in particular to an air conditioning system utilizing phase change material to store thermal energy.

BACKGROUND

Some air conditioning systems employ phase change materials to improve capacity and/or performance of the system. Exemplary air conditioning systems may include energy storage systems which freeze a phase change material when energy costs are relatively low (e.g., during non-peak times). The phase change material is then used to absorb thermal energy during other modes of operation to improve efficiency and/or capacity of the air conditioning system.

BRIEF DESCRIPTION OF THE INVENTION

In one aspect, an air conditioning system is provided. The air conditioning system includes a refrigeration circuit having a refrigerant and an economizer circuit, and a subcooling circuit thermally coupled to the refrigeration circuit, the subcooling circuit including a thermal energy storage (TES) unit and a phase change material (PCM) for thermal exchange with the refrigerant.

In another aspect, a method of operating an air conditioning system is provided. The method includes operating a refrigeration circuit to cool a first portion of refrigerant, cooling a second portion of the refrigerant in an economizer circuit, and operating a subcooling circuit thermally coupled to the refrigeration circuit. The subcooling circuit includes a thermal energy storage (TES) unit and a phase change material (PCM) for thermal exchange with the first portion of refrigerant.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
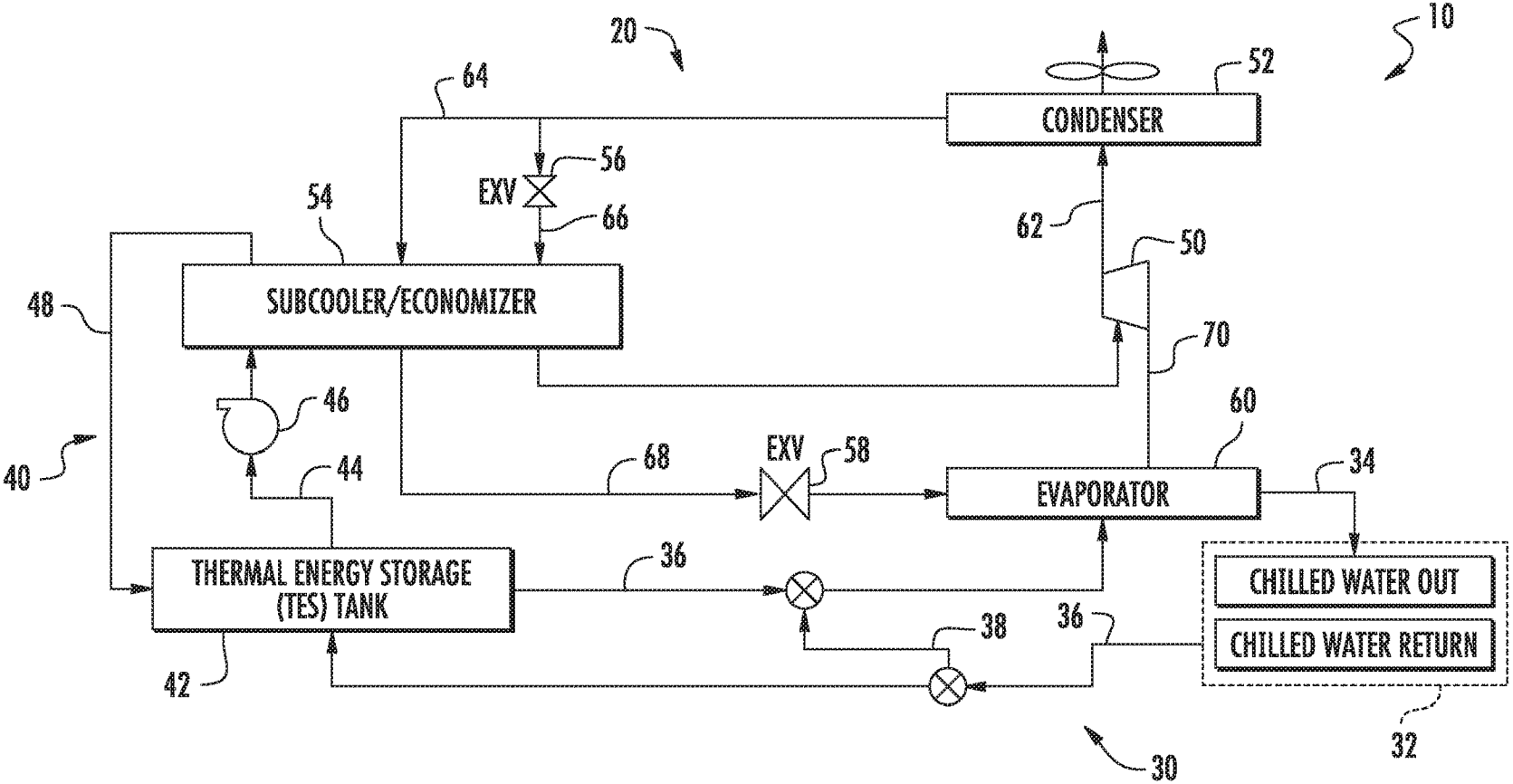
FIG. 1 is a schematic illustration of an exemplary air conditioning system.

FIG. 1 illustrates an exemplary air conditioning system 10 that generally includes a refrigeration unit or circuit 20 a heat exchange unit or circuit 30, and a subcooling unit or circuit 40.

Refrigeration circuit 20 generally includes a compressor 50, a condenser 52, a subcooler/economizer heat exchanger 54, an expansion device 56, an expansion device 58, and an evaporator 60. Condenser 52 is arranged to receive high pressure refrigerant in a vapor state from compressor 50 via a discharge line 62. Typically, the refrigerant in condenser

52 is cooled using cooling water, air, or the like, which carries away the heat of condensation. The refrigerant is condensed in condenser 52 and a first portion is supplied via line 64 to heat exchanger 54 to be cooled therein. A second portion of the condensed refrigerant is reduced in temperature and pressure in expansion device 56 and is supplied via an economizer line 66 to heat exchanger 54 for cooling of the first portion of condensed refrigerant. The warmed second portion of condensed refrigerant is then returned to the economizer port of compressor 50.

During predetermined times, the first portion of refrigerant receives supplemental cooling (e.g., subcooling) from subcooling circuit 40 and/or the expanded refrigerant in line 66 within heat exchanger 54, as is described herein in more detail. The cooled refrigerant is then supplied to evaporator 60 via a conduit line 68. In the exemplary embodiment, heat exchanger 54 functions both as a subcooling heat exchanger and/or as an economizer heat exchanger for refrigeration circuit 20. However, heat exchanger 54 may be one or more heat exchangers.

Expansion device 58 (e.g., an expansion valve) is mounted within conduit line 68 and serves to throttle the liquid refrigerant down to a lower pressure and to regulate the flow of refrigerant through the system. Due to the expansion process, the temperature and pressure of the refrigerant is reduced prior to entering evaporator 60.

In evaporator 60, the refrigerant is brought into heat transfer relationship with heat exchange circuit 30, which circulates a heat transfer medium such as water. The refrigerant at the lower pressure absorbs heat from the heat transfer medium and the refrigerant is subsequently vaporized. The refrigerant vapor is then drawn from evaporator 60 via compressor inlet line 70 and compressed to begin the cycle over again.

Heat exchanger circuit 30 exchanges thermal energy between evaporator 60, a serviced space 32 (e.g., a building), and a thermal energy storage (TES) unit 42. Heat exchanger circuit 30 includes a supply line 34, a return line 36, and a bypass line 38. A supply pump (not shown) supplies water chilled (e.g., about 45° F.) by evaporator 60 to serviced space 32 where a fan draws air over a coil to chill a space as known in the art. Chilled return water (e.g., about 55° F.) is transferred via return line 36 where it may be directed back to evaporator 60 via bypass line 38 or directed to TES unit 42 for storage and/or cooling.

Subcooling circuit 40 includes TES unit 42, a supply line 44, a pump 46, and a return line 48. In the exemplary embodiment, TES unit 42 utilizes a volume of phase change material (PCM) to store thermal energy. Pump 46 supplies the cooled PCM slurry via line 44 to heat exchanger 54 to subcool the first portion of refrigerant passing therethrough. The PCM may be an organic wax material having a transition temperature higher than a typical nighttime temperature, or over about 32° F., and lower than the typical daytime ambient air. The higher transition temperature of the PCM, when compared to a typical water/ice system, results in more efficient operation of system 10 when charging (i.e., cooling) the PCM. However, the PCM may be any suitable material that enables system 10 to function as described herein. For example, the PCM may include fatty acids, paraffinic waxes, or organic salt solutions. Further, subcooling circuit 40 may use water or brine (e.g., ammonia, ethyl glycol solution) as a heat exchange fluid. Although not shown, return line 48 may include one or more heat exchangers (not shown) for cooling the PCM returning to TES unit 42.

TES unit 42 and the PCM are able to utilize the enthalpy of the phase change in addition to the sensible capacity of the medium. TES unit 42 is used in conjunction with an air conditioning system (e.g., a chiller system) to time shift the use of energy by charging and discharging the PCM at different times. For example, the PCM can be recharged during the night by heat exchanger circuit 30 when the chiller is typically not needed to cool space 32. During the day, TES unit 42 is discharged to assist the chiller in providing cooling to space 32.

In operation during a first predetermined time or above a first predetermined temperature (e.g., during the day), system 10 is operated to cool serviced space 32 by transferring thermal energy stored in TES unit 42 to refrigeration circuit 20, which conveys cooled refrigerant to evaporator 60. Specifically, refrigerant is directed from condenser 52 to heat exchanger 54 via line 64. The refrigerant is subsequently lowered in temperature by cooled refrigerant in economizer line 66 and/or by cooled PCM circulating through subcooling circuit 40. The cooled refrigerant from line 64 is expanded via expansion device 58 and is subsequently utilized to chill the water passing through evaporator 60. The water chilled in evaporator 60 is then supplied via supply line 34 to serviced space 32, where the chilled water is used to cool an air supply that is distributed to space 32 at a selected supply air temperature. The chilled water is then directed back to evaporator 60 via return line 36 and bypass line 38 to repeat the cycle.

In operation during a second predetermined time or below a second predetermined temperature (e.g., during the night), system 10 is operated to charge TES unit 42 to store thermal energy that may be used to provide additional cooling during the first predetermined time. In this operation, the PCM is not circulated through circuit 40 and bypass line 38 is closed. The PCM in TES unit 42 is cooled or recharged by circulation of chilled water through TES unit 42 (rather than through bypass line 38) as the chilled water is returned via line 36 to evaporator 60. Additionally, or alternatively, the PCM in TES unit 42 may be cooled or recharged by ambient air.

In another operation mode, both the PCM and the first portion of refrigerant are cooled by the second portion of the refrigerant through heat exchanger 54 when cooling load in the chiller is low.

Figure 2:
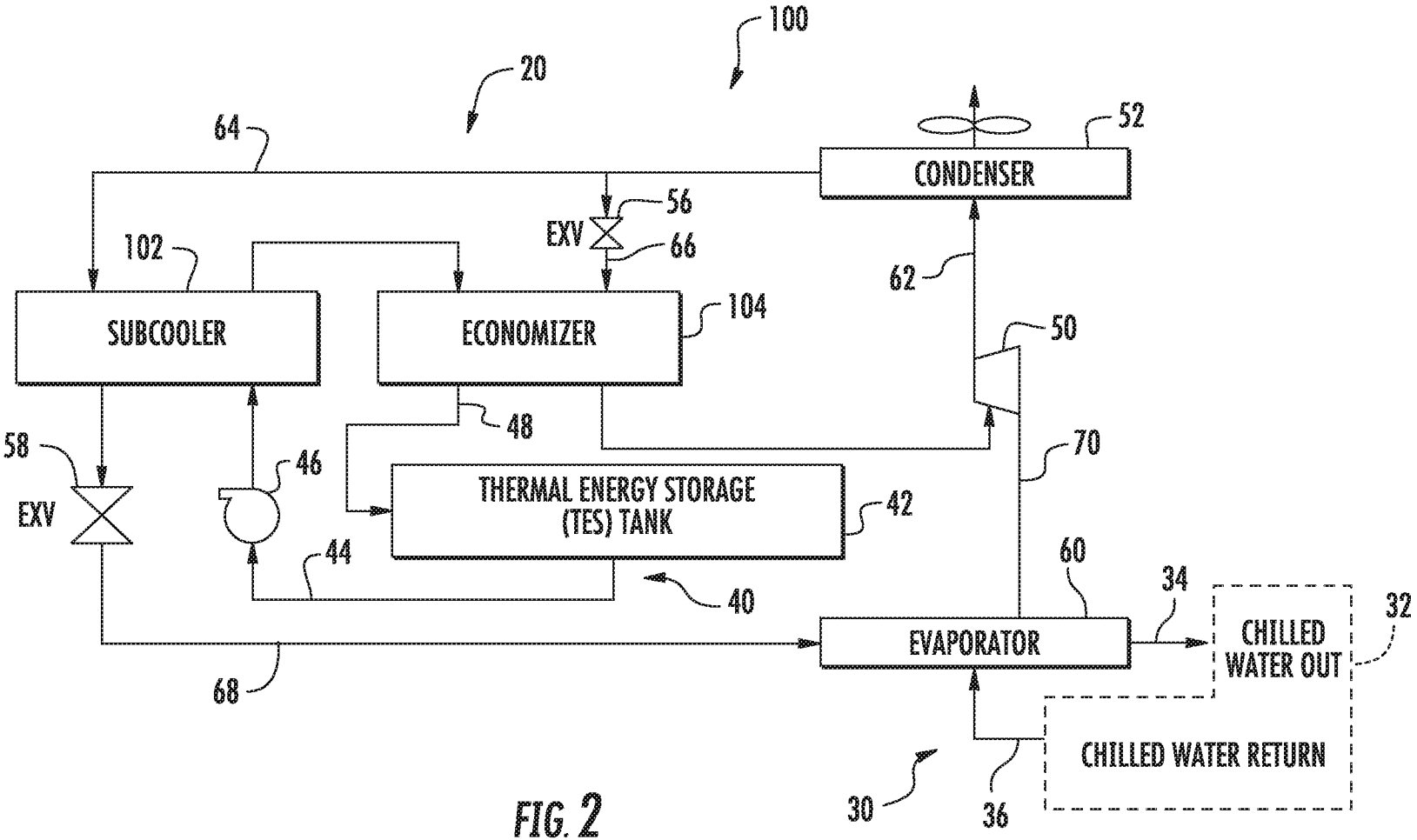
FIG. 2 is a schematic illustration of another exemplary air conditioning system.

FIG. 2 illustrates an exemplary air conditioning system 100 that is similar to system 10 except refrigeration circuit 20 includes a separate subcooler heat exchanger 102 and economizer heat exchanger 104.

In operation during the first predetermined time or above the first predetermined temperature (e.g., during a peak time of day), system 100 is operated to cool serviced space 32 by transferring thermal energy stored in TES unit 42 to refrigeration circuit 20, which conveys cooled refrigerant to evaporator 60. Specifically, refrigerant is directed from condenser 52 to heat exchanger 102 via line 64. The refrigerant is subsequently lowered in temperature by cooled PCM circulating through subcooling circuit 40. The cooled refrigerant from line 64 is expanded via expansion device 58 and is subsequently utilized to chill the water passing through evaporator 60. The water chilled in evaporator 60 is then supplied via supply line 34 to serviced space 32, where the chilled water is used to cool an air supply that is distributed to space 32 at a selected supply air temperature. The chilled water is then directed back to evaporator 60 via return line 36 to repeat the cycle. In addition, cooled refrigerant may be directed via economizer line 66 to economizer heat exchanger 104 to provide further cooling to the PCM circulating therethrough.

In operation during the second predetermined time or below the second predetermined temperature (e.g., during a non-peak time or at night), system 100 is operated to charge TES unit 42 to store thermal energy that may be used to provide additional cooling during the first predetermined time. In this operation, PCM, which may be discharged of previously stored cooling capacity, is supplied to economizer heat exchanger 104, where it is cooled by heat exchange with cooled refrigerant from expansion device 56 in economizer line 66. The PCM is cooled or recharged and subsequently stored in TES unit 42 until additional cooling is needed during the first predetermined time. Additionally, or alternatively, subcooling circuit 40 may include one or more heat exchangers (not shown) for cooling or recharging the PCM by ambient air. Further, depending on the load conditions, PCM may be partially cooled by the expanded refrigerant through heat exchanger 104 and partially cool the refrigerant from condenser 52 through heat exchanger 102.

Further, systems 10, 100 may include a controller (not shown) programmed to selectively operate subcooling circuit 40 to circulate cooled PCM stored in TES unit 42 to provide additional or supplemental cooling to refrigeration circuit 20 during predetermined times. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

The systems and methods described herein provide an economized air conditioning system integrated with a subcooling circuit having a thermal energy storage unit utilizing phase change materials. The phase change materials are cooled or recharged and subsequently stored in the thermal energy storage unit until supplemental cooling is desired. In one embodiment, the phase change materials are cooled using chilled water circulated in a chiller for conditioning a serviced space. In another embodiment, the phase change materials are cooled using the economizer circuit of the air conditioning system. By recharging the phase change materials during off-peak times and subsequently using the cooled phase change materials during peak times, significant energy and cost savings may be realized.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air conditioning system comprising:

a refrigeration circuit having a refrigerant and an economizer circuit, the refrigeration circuit including a compressor, a condenser, a heat exchanger, and an evaporator; and a subcooling circuit thermally coupled to the refrigeration circuit, the subcooling circuit including a thermal energy storage (TES) unit and a phase change material (PCM) for thermal exchange with the refrigerant;

a heat exchanger circuit having a heat transfer medium and thermally coupled to the refrigeration circuit and the subcooling circuit, the heat transfer medium cooled by the evaporator;

wherein the heat exchanger circuit is thermally coupled to the TES unit to transfer thermal energy from the heat transfer medium cooled by the evaporator to the subcooling circuit to cool and charge the PCM stored in the TES unit and return the heat transfer medium to the evaporator.

2. The system of claim 1, wherein the refrigeration circuit further comprises:

a first conduit fluidly coupled between the condenser and the heat exchanger and configured to supply a first portion of the refrigerant from the condenser to the heat exchanger; and a second conduit fluidly coupled between the first conduit and the compressor and configured to supply a second portion of the refrigerant from the condenser to the heat exchanger, wherein the second conduit is the economizer circuit.

3. The system of claim 1, wherein the subcooling circuit is thermally coupled to the refrigeration circuit via the heat exchanger.

4. The system of claim 1, wherein the heat exchanger circuit is thermally coupled to the evaporator to transfer thermal energy between a serviced space and the refrigeration circuit, thus cooling the serviced space.

5. The system of claim 1, wherein the heat exchanger circuit comprises a bypass line configured to bypass the heat transfer medium around the TES unit.

6. The system of claim 1, wherein the heat exchanger comprises a first heat exchanger and a second heat exchanger.

7. The system of claim 6, wherein the refrigeration circuit further comprises:

a first conduit fluidly coupled between the condenser and the first heat exchanger and configured to supply a first portion of the refrigerant from the condenser to the first heat exchanger; and a second conduit fluidly coupled between the first conduit and the compressor and configured to supply a second portion of refrigerant form the condenser to the second heat exchanger, wherein the second conduit is the economizer circuit.

8. The system of claim 7, wherein the subcooling circuit is thermally coupled to the first heat exchanger and the second heat exchanger, the subcooling circuit configured to selectively supply cooled PCM stored in the TES unit to the first heat exchanger to provide supplemental cooling to the refrigeration circuit.

9. The system of claim 1, wherein the PCM has a transition temperature of greater then 32 degrees F.

10. A method of operating an air conditioning system, the method comprising:

operating a refrigeration circuit to cool a first portion of refrigerant, the refrigeration circuit configured to cool a heat transfer medium supplied to a serviced space;

cooling a second portion of the refrigerant in an economizer circuit; and operating a subcooling circuit thermally coupled to the refrigeration circuit, the subcooling circuit including a thermal energy storage (TES) unit and a phase change material (PCM) for thermal exchange with the first portion of refrigerant;

directing the heat transfer medium to the TES unit to transfer thermal energy from the heat transfer medium cooled by the refrigeration circuit to the subcooling circuit to cool and charge the PCM stored in the TES unit and returning the heat transfer medium to the evaporator.

11. The method of claim 10, further comprising cooling the first portion of refrigerant in a heat exchanger with the PCM from the TES unit, the refrigeration circuit including a compressor, a condenser, and an evaporator.

12. The method of claim 11, further comprising cooling the first portion of refrigerant in the heat exchanger with the second portion of refrigerant.

13. The method of claim 10, further comprising:

cooling the first portion of refrigerant in a first heat exchanger with the PCM from the TES unit; and cooling the PCM in a second heat exchanger with the second portion of refrigerant, the refrigeration circuit including a compressor, a condenser, and an evaporator.

* * * * *